US006099094A

United States Patent [19]

Lior

[11] Patent Number: 6,099,094

[45] Date of Patent: Aug. 8, 2000

[54] MOUNTING ARRANGEMENT FOR COMPUTERS

[76] Inventor: Ephraim E. P. Lior, 1880 Columbia Rd. #301, Washington, D.C. 20009

[21] Appl. No.: 09/226,140

[22] Filed: Jan. 7, 1999

Related U.S. Application Data

[60] Provisional application No. 60/070,993, Jan. 9, 1998.

[51] Int. Cl.[7] ..... A47B 81/00

[52] U.S. Cl. ..... 312/223.3; 312/223.2; 312/208.1; 108/50.01

[58] Field of Search ..... 312/223.2, 223.1, 312/223.3, 208.1, 247, 194, 334.23, 334.24, 334.25; 108/50.01, 50.02; 361/683, 724, 725, 727

[56] References Cited

U.S. PATENT DOCUMENTS

| | | | |
|---|---|---|---|
| 4,600,249 | 7/1986 | Anderson | 312/223.3 |
| 4,624,510 | 11/1986 | Jedziniak | 312/223.3 |
| 4,766,422 | 8/1988 | Wolters . | |
| 4,861,121 | 8/1989 | Gotz . | |
| 5,287,815 | 2/1994 | Gross | 312/208.1 X |
| 5,377,951 | 1/1995 | Johnson et al. | 312/208.1 X |
| 5,571,256 | 11/1996 | Good et al. | 312/223.1 X |
| 5,577,821 | 11/1996 | Chu . | |
| 5,623,881 | 4/1997 | Huang | 108/50.01 |
| 5,626,323 | 5/1997 | Lechman et al. | 108/50.01 X |
| 5,701,231 | 12/1997 | Cuong Do . | |
| 5,769,514 | 6/1998 | Brown et al. | 108/129 X |
| 5,825,615 | 10/1998 | Ohara . | |

FOREIGN PATENT DOCUMENTS

| | | | |
|---|---|---|---|
| 3342245 | 5/1985 | Germany | 312/223.3 |
| 3516855 | 11/1986 | Germany | 312/223.3 |

*Primary Examiner*—Peter M. Cuomo
*Assistant Examiner*—Hanh V. Tran
*Attorney, Agent, or Firm*—William D. Hall

[57] ABSTRACT

A computer is mounted closely adjacent the underside of a table top. Mounting brackets are attached to and carried by the table top. The computer is connected to the brackets by a first set of guides which permit the computer to move along a path which at one end has the computer under the table top and has the computer out from under the table top at the other end. A keyboard is attached to the computer by a second set of guides. This second set of guides allows the keyboard to move from a position under the computer to a location at which the keyboard is not under the computer.

15 Claims, 10 Drawing Sheets

17a
17b
17
17c
17a
17b
17c
17a
17b
17c

MOUNTING ARRANGEMENT FOR COMPUTERS

RELATED APPLICATION

This application claims the benefit of U.S. Provisional Application Ser. No. 60/070,993 filed Jan. 9, 1998.

BACKGROUND OF THE INVENTION

The prior art includes various shapes and forms for personal desk top computers such as desktop computers and tower computers. These, have not been mounted in a compact form where they are conveniently located for operation, readily exposed for inspection, repair, parts replacement and/or upgrades and protected from theft.

SUMMARY OF THE INVENTION

A computer, and its keyboard, are mounted under a table top or desk top. The front part of the computer is thinner than the rear part to form a space for the keyboard. The keyboard is mounted under said front part of the computer and may slide outward (away from the table or desk) relative to the computer itself. The computer is also mounted on guides so that it may move from its retracted position under the top of the table or desk to an extended position. When in such an extended position the electrical components of the computer are exposed for inspection, repair, parts replacement and/or upgrades.

DETAILED DESCRIPTION OF THE INVENTION

Figure 1:
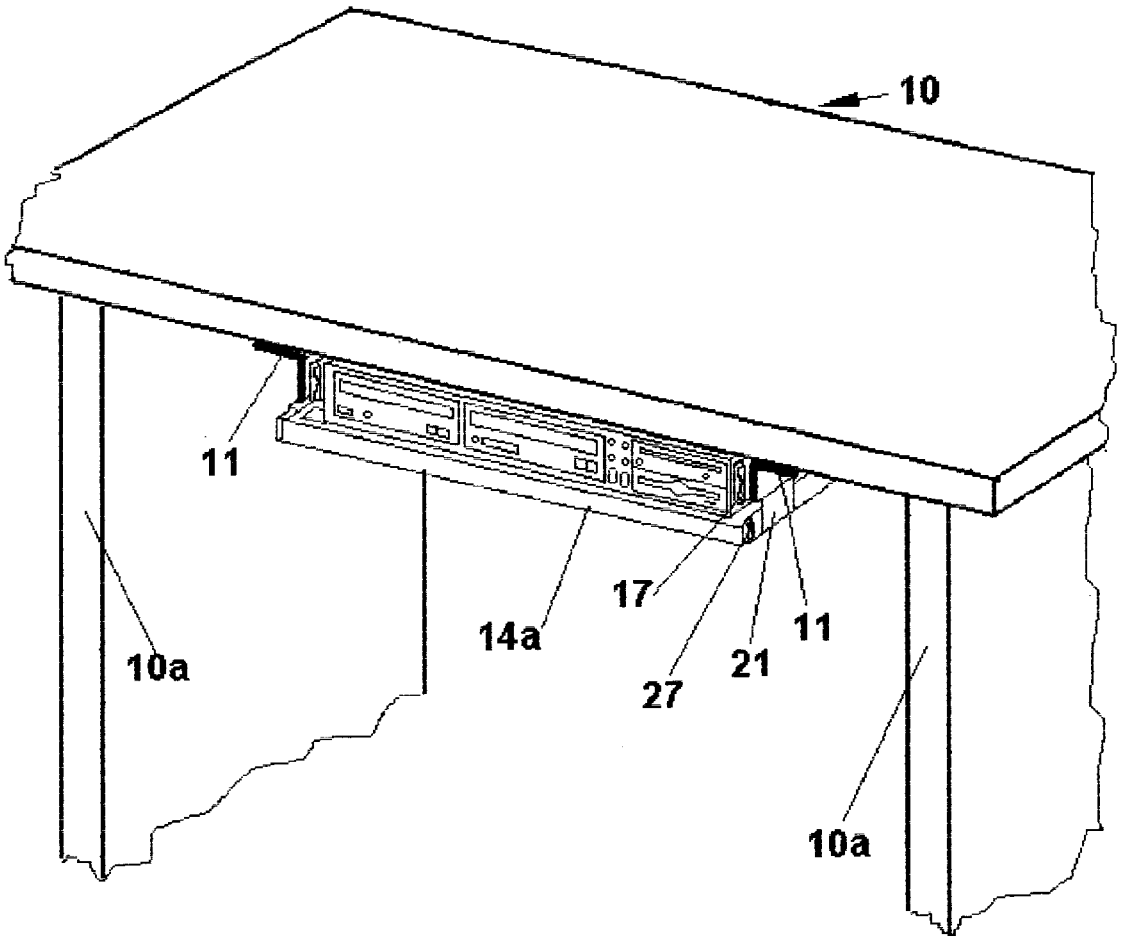
FIG. 1 illustrates a desk top with a computer, and its keyboard, mounted on the underside of the desk top. The computer is in its retracted position under the desk top. The keyboard is in its retracted position under the computer.

In FIG. 1 the table or desk 10 has legs 10*a,* a top side 10*c* and an under side 10*d.* The brackets 11 have one side fastened to the lower side 10*d* of table or desk 10. The computer 12 is connected to the brackets 11 by connecting guides 17 that enable the computer to be pulled outward and away from the table or desk 10.

The keyboard 14 is connected to the brackets 21 by guides 27, which enable the keyboard 14 to be pulled outward relative to the computer 12. Detailed view of guides 17 and 27 are shown in FIGS. 7, 8, and 9.

Figures 7, 8, 9:
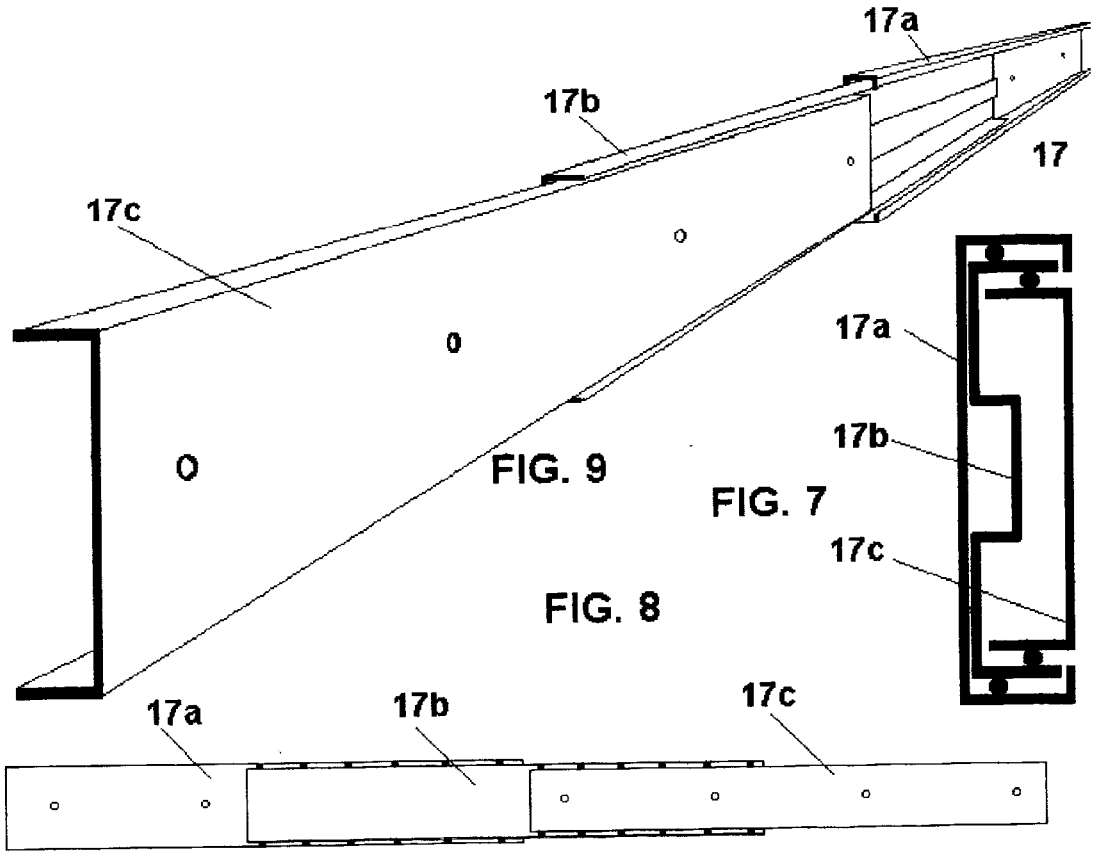
FIGS. 7, 8, and 9 show the details of a typical guide for supporting the computer. Guides of same type, but of smaller size support the keyboard.

FIG. 7 is a schematic front view of a typical three member sliding guide, where external part 17*a* and internal part 17*c* are connected together by the media part 17*b.* Sets of balls allow translational movement of part 17*a* relative to part 17*b,* and of part 17*c* relative to part 17*b.* Therefore part 17*c* can be extended to the position, when it is not inside of part 17*a* and the same time retaining connection between them via part 17*b* at all phases of the translational movement, as shown in perspective view in FIG. 9, and in side view in FIG. 8. The hardware market offers a wide variety of sizes, strengths, etc. of sliding guides suitable for use as a part of the invention.

Figure 2:
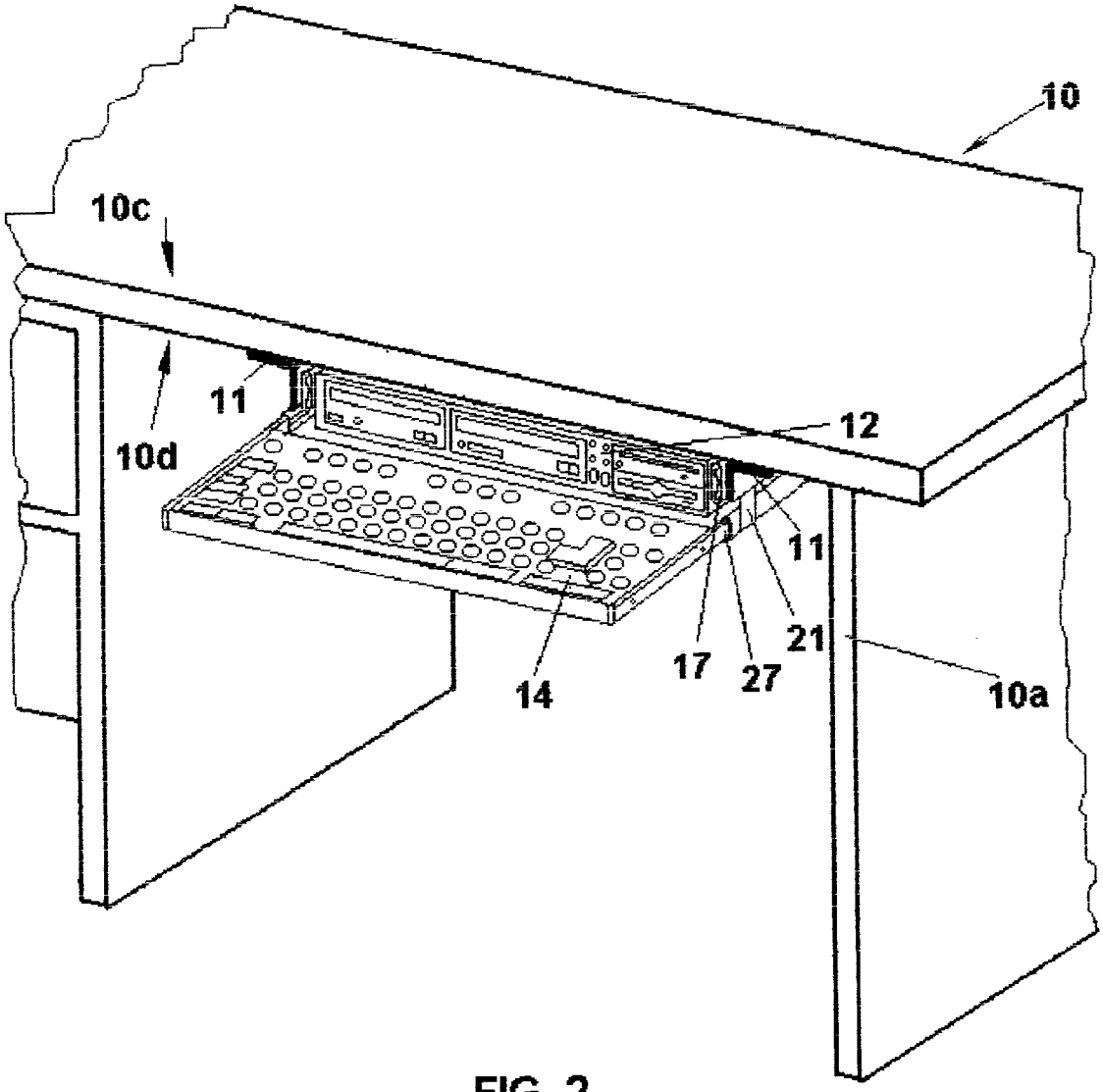
FIG. 2 is similar to FIG. 1, except that the keyboard has been moved outwardly to an operating position.
Figure 3:
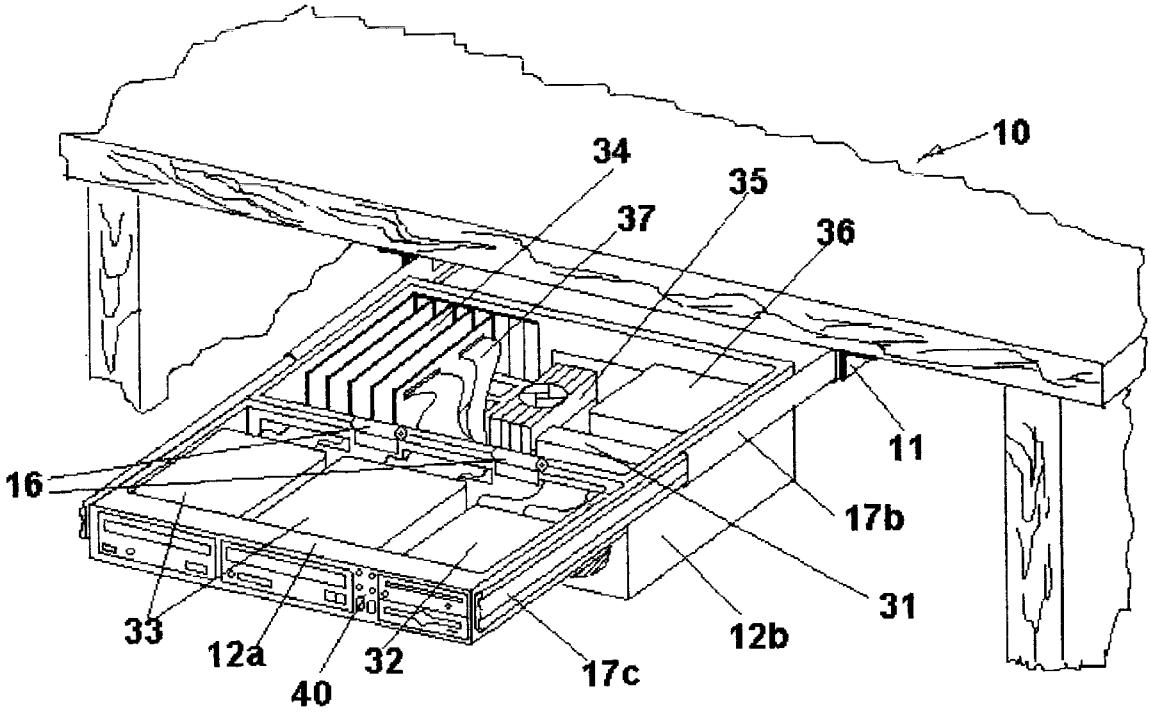
FIG. 3 is a view similar to FIG. 1 except that the computer has been moved outwardly from the desk to expose the components of the computer. The keyboard is not installed.

Guides as shown in FIG. 7 allow the computer 12 to move along a path extending from under the table top (see FIG. 1) to a location wherein the computer is not under the table top (see FIG. 3). Guides 27 (FIG. 5) are similar to guides 17 except smaller. Guides 27 (FIG. 5) are carried by the computer 12 and support keyboard 14. Guides 27 allow the keyboard 14 to move from under the computer 12 to a position that is not under the computer 12 as shown in FIG. 2.

Figure 4:
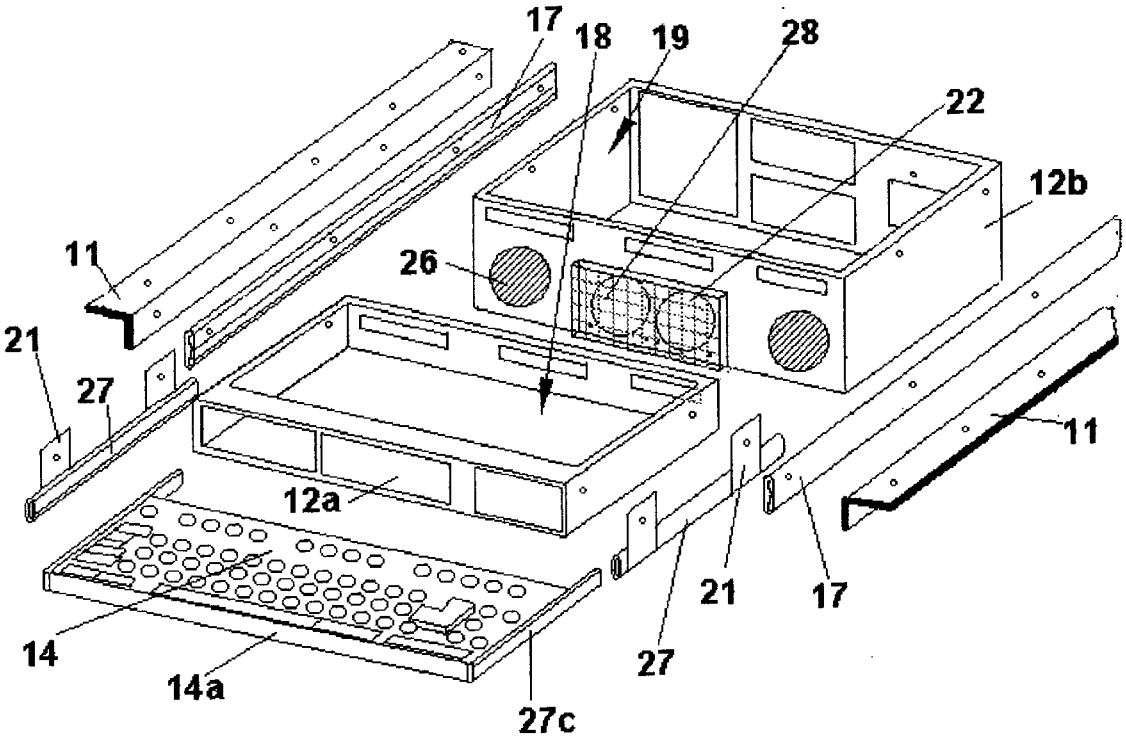
FIG. 4 is an exploded view of the various parts of the computer and the apparatus for mounting it.

The front part 12*a* of the computer is thinner (FIG. 4) than its rear part 12*b.* This provides a space under the front part 16, for the keyboard 14 when the keyboard 14 is in its retracted position of FIG. 1.

When the computer 12 is pulled away form the table 10, as shown in FIG. 3, the internal components such as hard disk 31, 3.5" devices 32, floppy, zip or backup tape drives, 5.25" devices 33, CD-ROM or DVD drives, the printed circuit boards 34, processor with heat sink and fan 35, power supply 36, ribbon connectors 37 are exposed and therefore are clearly available for inspection, repair, replacement and/or upgrades. Wires and ribbon connectors 37 go from rear part 12*b* of the computer to the front part 12*a* through the wire slots 25, Components of the computer 12 are not limited by those shown in FIG. 3 and may vary due to different computer models and configurations, which does not effect the essence of the invention due to standard dimensions of interchangeable components. Control buttons, control lights and connectors for external devices like microphone, earphone, video camera, are located on the front panel 40 of the computer 12.

Figure 10A:
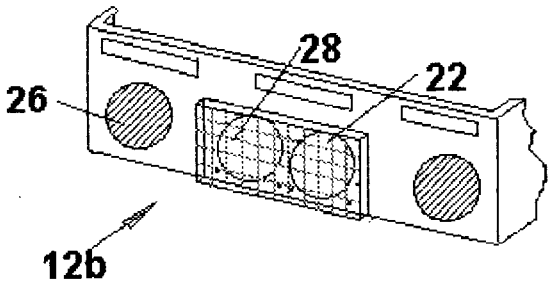
FIGS. 10A, 10B and 10C are the views of the rear part of the computer showing the filter system and the speakers.
Figure 10B:
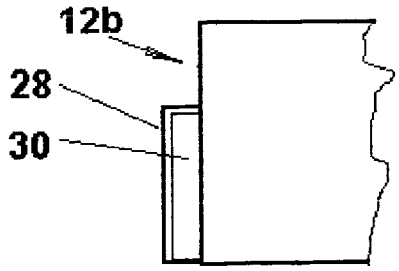
Figure 10C:
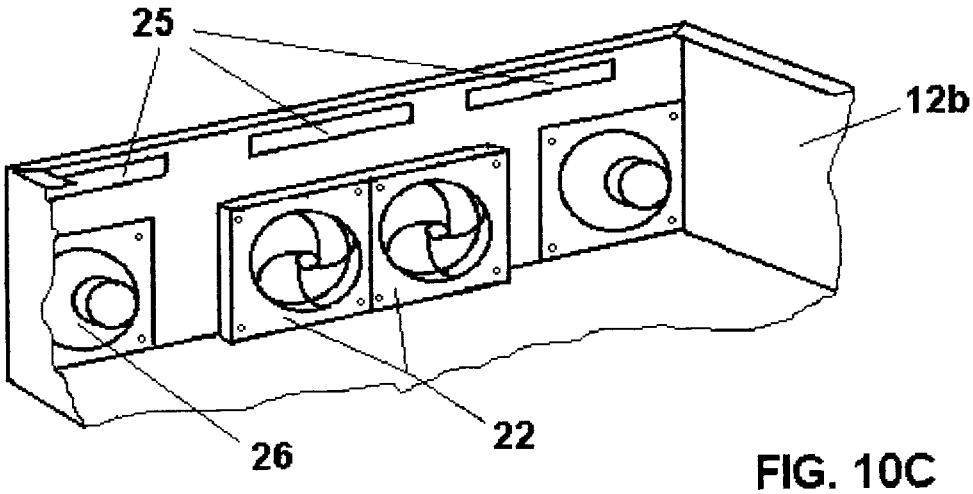

Speakers 26, fans 22, filter 30, inserted in grid box 28 are shown in FIGS. 10A, 10B, and 10C. Fans are installed in such a way that they direct the air from outside of the computer 12 through the filters into the computer, which creates positive air pressure in the computer, preventing dust from getting inside of it. The filter is not shown in FIG. 4 so fans 22 can be seen through the grid filter box 28.

Figure 5:
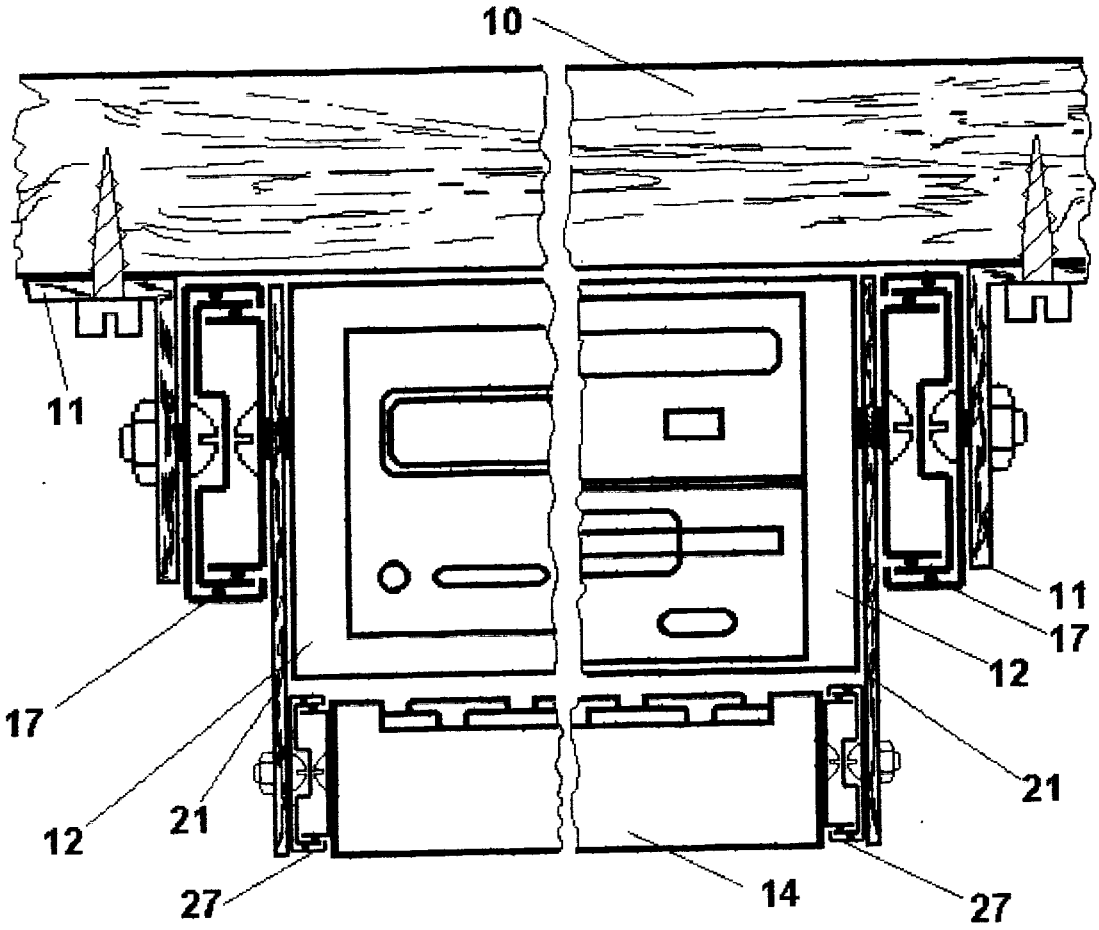
FIG. 5 is a vertical cross-sectional view of the apparatus constituting invention.
Figure 6:
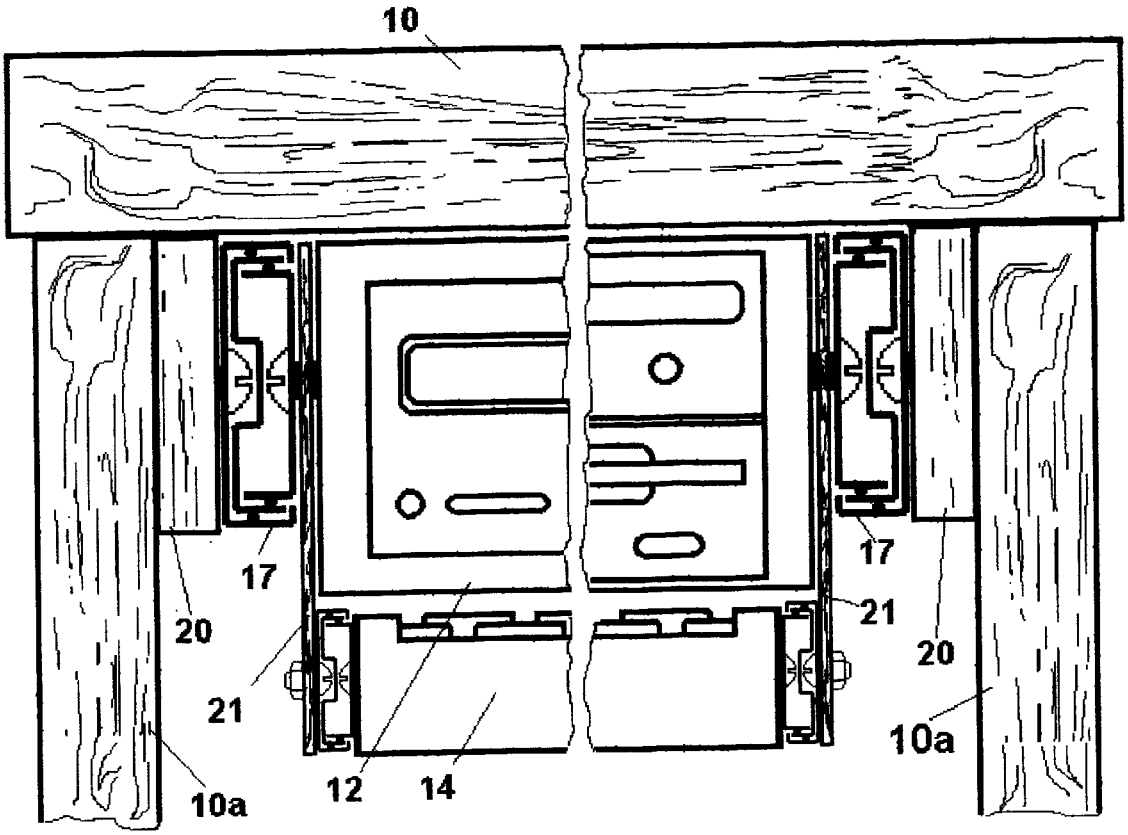
FIG. 6 is a modified form of the invention.

In FIG. 6 guides 17 are not connected to the table top by the brackets as they are in FIG. 5. Instead, guides 17 are connected to the vertical parts of a table, in this case legs 10*a,* still remaining adjacent to the underside of a table top 10. Spacers 20 are used to adjust proper fit when the width of the computer 12 with guides is lesser than the distance between the table legs or drawer cabinets that they connect to.

Figure 11:
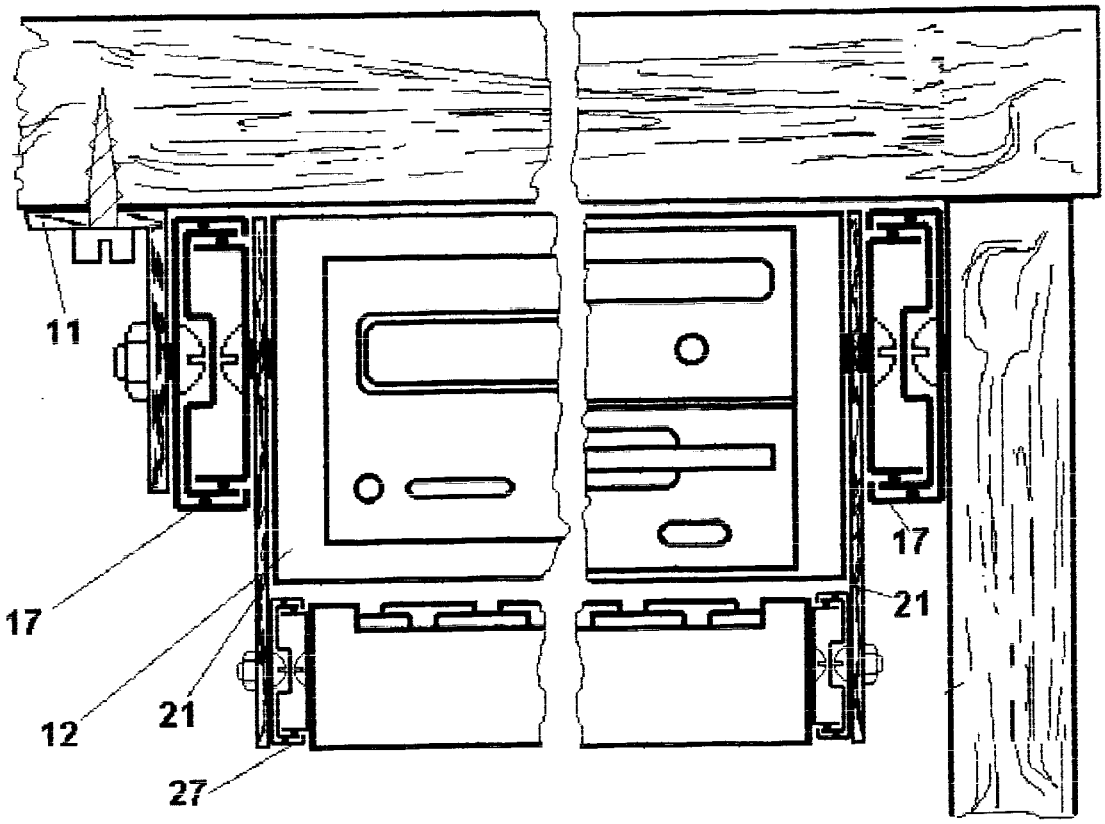
FIG. 11 is a modified form of invention, and is a combination of FIG. 5 and FIG. 6.

Installation as shown on the FIG. 11 is a combination of a top mounting as in FIG. 5 and a side mounting as in FIG. 6.

Figure 12F:
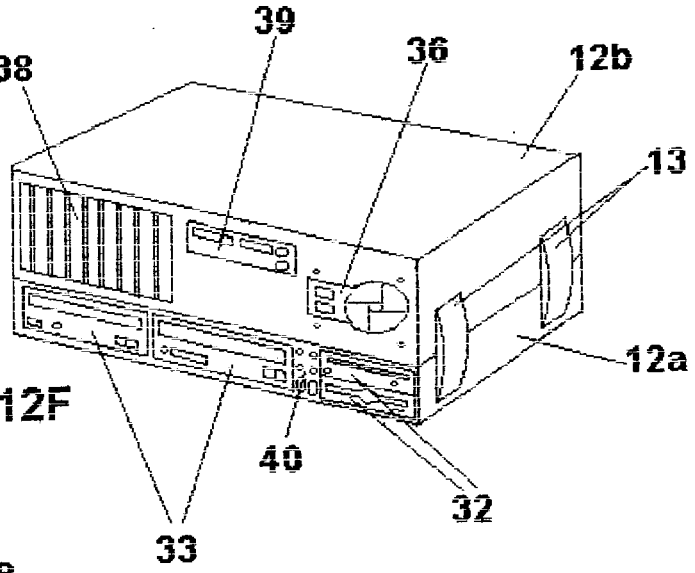
FIGS. 12F and 12R are front and rear views of the computer in a folded mode.
Figure 12R:
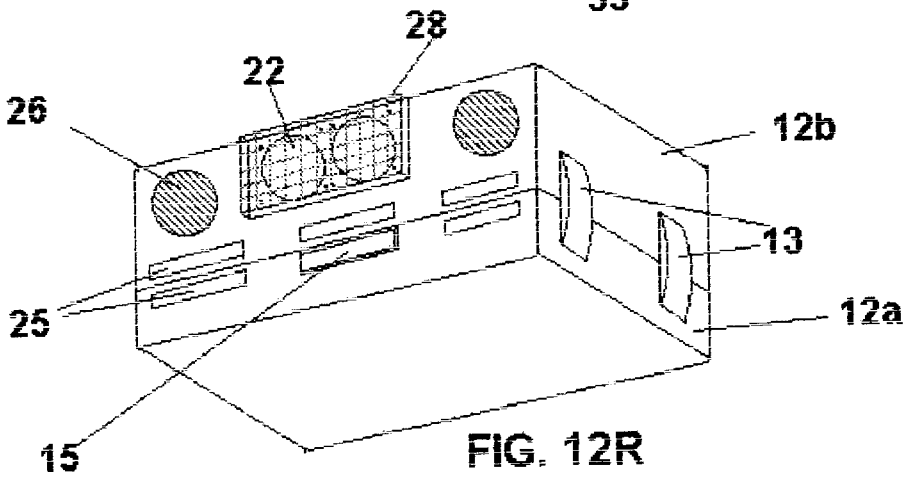

When computer 12 is disconnected from the connecting guides 17, front 12*a* and rear 12*b* parts become either disconnected from each other or connected by one or more hinges, which enables them to be folded in a way that their top rims meet and that they close each other's top openings 18 and 19. In this position front 12*a* and rear 12*b* parts are locked by latches 13, computer can be transported or used as an alternative option not requiring permanent installation. Ribbon connectors and wires connect components within inner space of the computer without going through wire slots 22. Wire slots 22 are closed by plastic plugs 15. On FIG. 12F are also shown standard circuit board connection panel 38, communication ports panel 39, and standard power supply.

When computer 12 is disconnected from the connecting guides 17, front 12*a* and rear 12*b* parts may become either disconnected from each other, alternatively they connected by one or more hinges 16 as shown in FIG. 3. The hinges enable the parts 12*a* and 12*b* to be folded in a way that their top rims meet and that they close each other's top openings 18 and 19. In this position front 12*a* and rear 12*b* parts are locked by latches 13. When so locked, the computer can be transported. It may also be used as an alternative option not requiring permanent installation. Ribbon connectors and wires connect components within the inner space 5 of the computer without going through wire slots 22. Wire slots 22 are closed by plastic plugs 15. On FIG. 12F, a standard circuit board connection panel 38, communication ports panel 39, and standard power supply are shown.

The words "table top" is defined as having a horizontal member mounted in spaced relation to a floor by legs or other means and wherein there is an open space below the horizontal member in which a computer may be mounted. The horizontal member has a top side and an underside.

An "electronic computer" is defined as a device that has internal components, including memory and a digital computing device. The words "electronic computer" as used herein do not include either the keyboard or the monitor even though those elements are connected to the computer and may be necessary to at least some of the uses of the computer. The "electronic computer" as herein defined performs its computations by controlling electrical currents and/or light beams to perform mathematical computations.

I claim to have invented:

1. An apparatus for mounting a computer adjacent to the underside of a top of a table, comprising:

an electronic computer, a keyboard, a mounting structure for mounting said electronic computer under and adjacent to the underside of said top, and means for guiding said computer from a location under the top of the table to a position where the computer is not under the top of the table and for carrying the keyboard with the computer when the computer is moved to said position and for allowing the keyboard to be further moved to another position that is not under either the computer or the top of the table.

2. An apparatus as defined in claim 1, in which said computer has a number of internal components and an opening in its top so that said internal components may be inspected.

3. An apparatus as defined in claim 1, in which, when said computer is mounted adjacent to the underside of said table top said computer has a front part and a rear part, said front part being positioned to come out from under said table top before said rear part comes out from under said table top, when the computer is moved from under said table top, said front part, when said structure is mounted on the underside of said table top, extending below said table top for a lesser distance than said rear part thus leaving a space below said front part, said keyboard being mounted in said space.

4. An apparatus as defined in claim 3, in which:

said means including means for mounting said keyboard in said space and for guiding said keyboard along a path extending outwardly from underneath said front part to a position at which the keyboard is exposed and may be operated by the fingers of an operator.

5. An apparatus as defined by claim 1 in which said means includes guide means and in which said computer and said keyboard are connected by said guide means, said guide means permitting the keyboard to be moved.

6. An apparatus as defined in claim 1 in which said mounting structure is adapted to be attached to and carried by the underside of said top.

7. Apparatus as defined in claim 1, in which said electronic computer has two parts and means for connecting said parts together while allowing one of said parts to be folded onto the other of said parts.

8. The combination of an electronic computer and a table top comprising:

said table top having an underside, and means carried by said table for positioning said computer immediately below said underside, said means including a first guiding device which guides said computer along a path extending to a location of said computer that is not under said table top, a keyboard, and a second guiding device, carried by said means, which guides said keyboard along a path that extends from said location to a position where the keyboard is not under said computer.

9. The combination of claim 8, in which said computer has internal components and an open top so that, when the computer is moved to said location, the said internal components are exposed for inspection.

10. The combination of claim 8 in which said computer has a front part and a rear part, said front part of said computer having less thickness than said rear part, thus leaving a space under said front part.

11. The combination of claim 8 wherein said means that is carried by said table is attached to and supported by said top.

12. The combination of claim 8 in which said second guiding device is carried by said first guiding device and below said first guiding device.

13. The combination of claim 8, having a support for said second guiding device which moves said second guiding device when the computer moves.

14. An apparatus for mounting an electronic computer adjacent to the underside of a top of a table, comprising:

bracket means for attachment to the table, a guide for attachment to said bracket means, including means for attaching said computer to the guide, said guide and bracket means comprising means which when assembled mounts said electronic computer on said guide and adjacent to and under the table top, and a keyboard, said bracket means including means supporting the keyboard and allowing the keyboard to be moved from a position under said computer to a position that is not either under the computer or the top of the table.

15. An apparatus as defined in claim 14, wherein said guide comprises means for allowing said computer to move from a position under a table top to a position where the computer is at least partially not under the table top.

* * * * *